US005853337A

United States Patent [19]

Moriyama et al.

[11] Patent Number: 5,853,337

[45] Date of Patent: Dec. 29, 1998

[54] GOLF BALL

[75] Inventors: Keiji Moriyama; Akira Kato, both of Shirakawa, Japan

[73] Assignee: Sumitomo Rubber Industries, Ltd., Hyoto-Ken, Japan

[21] Appl. No.: 833,071

[22] Filed: Apr. 3, 1997

[30] Foreign Application Priority Data

Apr. 3, 1996 [JP] Japan ..... 108522

[51] Int. Cl.[6] ..... A63B 37/06; A63B 37/12

[52] U.S. Cl. ..... 473/365; 473/372

[58] Field of Search ..... 473/365, 357, 473/372, 377, 378

[56] References Cited

U.S. PATENT DOCUMENTS 5,702,312 12/1997 Horiuchi et al. ..... 473/377
5,740,853 1/1998 Maruko et al. ..... 473/363

*Primary Examiner*—George J. Marlo
*Attorney, Agent, or Firm*—Birch, Stewart, Kolasch & Birch, LLP

[57] ABSTRACT

The present invention provides a multi-layer structure golf ball having a thread rubber layer, which has good shot feel and attains long flight distance. The golf ball comprises a center made of a vulcanized molded article of a rubber composition, a thread rubber layer formed on the center and a cover formed on the thread rubber layer, wherein the center has a diameter of from 35 to 38 mm and a deformation amount, formed by applying a load to the center within the range from an initial load of 130 Kg to a final load of 130 Kg, of from 3.5 to 6 mm, and when the deformation amount of the center is defined as deformation amount (A) and a deformation amount of the golf ball, formed by applying a load to the golf ball within the range from an initial load of 10 Kg to a final load of 130 Kg, is defined as deformation amount (B), the deformation amounts (A) and (B) meet the following equation:

Deformation amount (A)−deformation amount (B)=0.5 to 3 mm.

3 Claims, 1 Drawing Sheet

GOLF BALL

FIELD OF THE INVENTION

The present invention relates to a golf ball. More particularly, the present invention relates to a multi-layer structure golf ball having a thread rubber layer, which has good shot feel and attains long flight distance.

BACKGROUND OF THE INVENTION

A multi-layer structure golf ball having a thread rubber layer is generally called as a "thread wound golf ball", and a base construction thereof is that thread rubber is wound in a stretched state (state where a tension is applied) around a solid center or a liquid center to form a thread rubber layer and the thread rubber layer is covered with a cover.

The multi-layer structure golf ball having a thread rubber layer is superior in shot feel and controllability to a two-piece solid golf ball using a solid core, but the spin amount is large and the launch angle is small in comparison with the two-piece solid golf ball. Therefore, many amateur golfers prefer the two-piece solid golf ball having a flight distance which is larger than that of the multi-layer structure golf ball having a thread rubber layer. Because of the reasons mentioned above, the two-piece solid golf ball has exclusively been sold in the market.

OBJECTS OF THE INVENTION

According to the present invention, the following object has been accomplished by increasing the diameter of the center of the golf ball and decreasing the deformation amount of the center in comparison with a conventional golf ball, to inhibit spin amount and to increase launch angle, thereby increasing flight distance.

Accordingly, the main object of the present invention is to solve the short flight distance problem of the multi-layer structure golf ball using a thread wound core by providing a golf ball which has good shot feel and attains a long flight distance, which is the same as or longer than that of the two-piece solid golf ball, while maintaining, as much as possible, the good shot feel of the multi-layer structure golf ball having a thread rubber layer.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
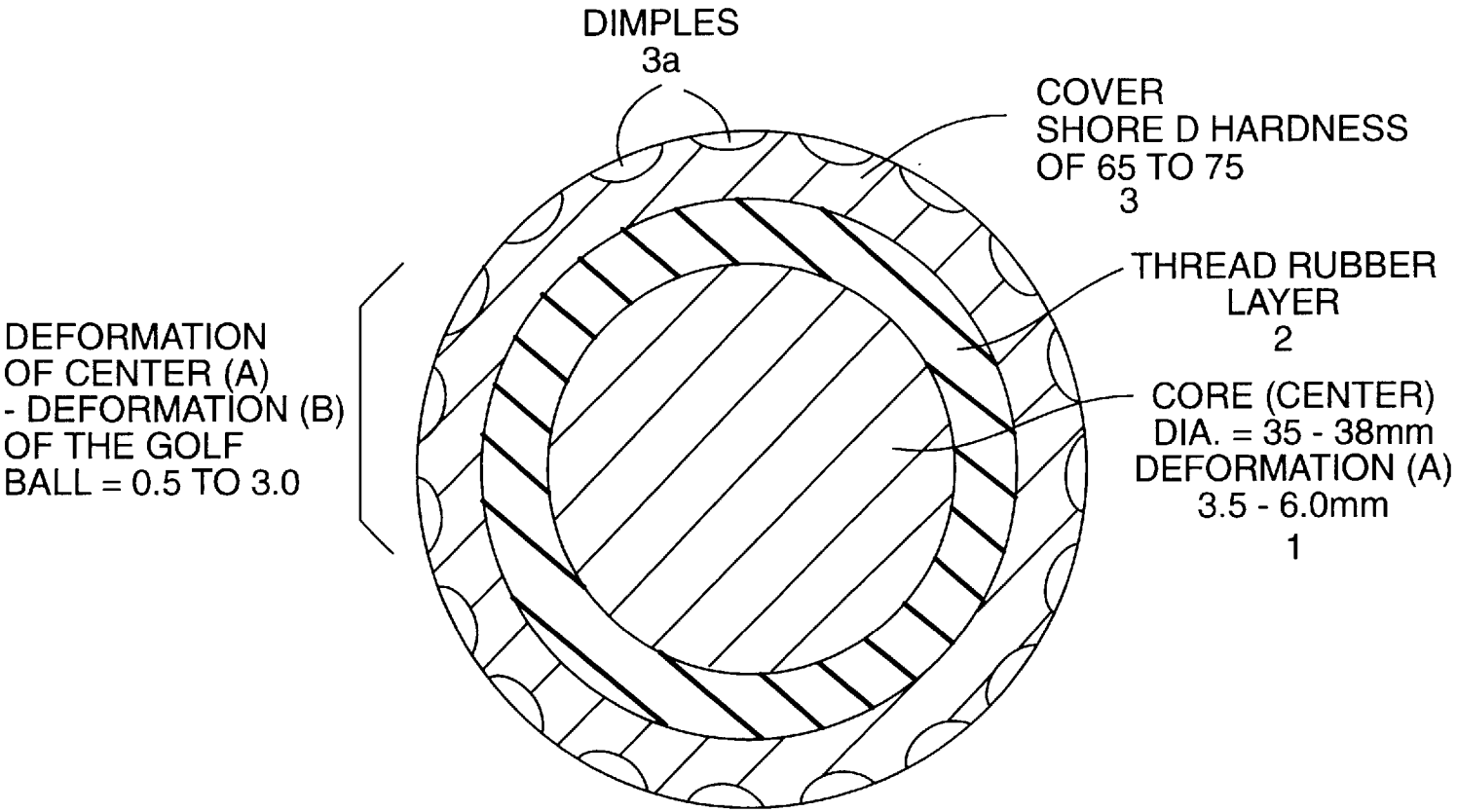
FIG. 1 is a schematic cross section illustrating one embodiment of the golf ball of the present invention.

The present invention provides a golf ball which comprises a center (core) made of a vulcanized molded article of a rubber composition, a thread rubber layer formed on the center and a cover formed on the thread rubber layer, wherein the center has a diameter of from 35 to 38 mm and a deformation amount, formed by applying a load to the center within the range from an initial load of 10 Kg to a final load of 130 Kg, of from 3.5 to 6 mm, and when the deformation amount of the center is defined as deformation amount (A) and a deformation amount of the golf ball, formed by applying a load to the golf ball within the range from an initial load of 10 Kg to a final load of 130 Kg, is defined as deformation amount (B), the deformation amounts (A) and (B) meet the following equation:

Deformation amount (A)−deformation amount (B)=0.5 to 3 mm.

DETAILED DESCRIPTION OF THE INVENTION

In order to carry out the present invention, more preferably, the center is preferably composed of a vulcanized molded article of a rubber composition prepared by formulating 19 to 27 parts by weight of an $\alpha,\beta$-unsaturated carboxylic acid metal salt to 100 parts by weight of the base rubber. The hardness of the cover is preferably from 65 to 75 in Shore D-scale hardness.

The present invention will be described in detail, hereinafter. By way of explanation, the expression "conventional golf ball" may be used in contrast with the golf ball of the present invention. The conventional golf ball refers to a multi-layer structure golf ball having a thread rubber layer which has been conventionally sold.

In the present invention, the diameter of the center is adjusted to 35–38 mm. When the diameter of the center is smaller than 35 mm, a launch angle is the same as that of the conventional golf ball. Therefore, an increase in flight distance is not obtained. On the other hand, when the diameter of the center is larger than 38 mm, the thickness of the thread rubber layer is decreased. Therefore, winding of the thread rubber has been finished before tension is applied to the thread rubber and it is impossible to obtain a suitable hardness required for the golf ball. Also, in this case, an increase in flight distance is not obtained.

In the present invention, the hardness of the center is evaluated by a deformation amount formed by applying a load to the center within the range from an initial load of 10 Kg to a final load of 130 Kg. The deformation amount of the center is adjusted to a value lower than that of the conventional golf ball, e.g. within the range of from 3.5 to 6 mm. When the deformation amount of the center is smaller than 3.5 mm, the center is too hard and shot feel is hard. Therefore, it is impossible to maintain good shot feel and the shot feel deteriorates to the same level as that of the two-piece solid golf ball. On the other hand, when the deformation amount of the center is larger than 6 mm, the shot feel is soft, but the rebound performance of the resulting golf ball is the same as that of the conventional golf ball. Therefore, an increase in flight distance is not obtained.

In the present invention, the hardness of the golf ball is evaluated by the deformation amount formed by applying a load to the center within the range from an initial load of 10 Kg to a final load of 130 Kg. The value obtained by subtracting the deformation amount (B) of the golf ball from the deformation amount (A) of the center is adjusted from 0.5 to 3 mm, wherein (A) is the deformation amount of the center and (B) is the deformation amount formed by applying a load to the golf ball within the range from an initial load of 10 Kg to a final load of 130 Kg. The value of the conventional golf ball is not less than 3.5 mm and the value of 0.5–3 mm in the present invention is smaller than that of the conventional golf ball. The present invention has accomplished the value of the above range by hardening the center. In the present invention, the reason why the value was specified to the above range is as follows.

When the value obtained by subtracting the deformation amount (B) of the golf ball from the deformation amount (A) of the center is smaller than 0.5 mm, the feeling at the time of hitting becomes hard. Therefore, it is impossible to maintain a good shot feel is and the shot feel is deteriorated with the same level as that of a two-piece solid golf ball. On the other hand, when the value obtained by subtracting the deformation amount (B) of the golf ball from the deformation (A) of the center is larger than 3 mm, the feeling at the time of hitting is soft, but the rebound performance of the resulting golf ball is the same as that of the conventional golf ball. Therefore, an increase in flight distance is not obtained.

The center is composed of a vulcanized molded article of a rubber composition, and the rubber composition is not specifically limited. For example, there can be used those containing a base rubber (e.g. hi-cis polybutadiene, etc.), a metal salt of an α,β-unsaturated carboxylic acid (e.g. zinc acrylate, zinc methacrylate, etc.), an organic peroxide and a filler.

As the base rubber of the rubber composition for center, the above-mentioned high-cis polybutadiene is preferable. In addition to this, for example, there can be used those prepared by blending (mixing) a natural rubber, polyisoprene rubber, styrene-butadiene rubber, etc. with the high-cis polybutadiene.

The metal salt of the α,β-unsaturated carboxylic acid has the action of vulcanizing (crosslinking) the rubber. As the metal salt of the α,β-unsaturated carboxylic acid, for example, zinc and magnesium salts of α,β-unsaturated carboxylic acids (e.g. acrylic acid, methacrylic acid, etc.) can be preferably used.

The amount of the metal salt of the α,β-unsaturated carboxylic acid in the rubber composition for center is preferably from 19 to 27 parts by weight, based on 100 parts by weight of the base rubber. When the amount of the metal salt of the α,β-unsaturated carboxylic acid is smaller than the above range, the center is soft. Therefore, the performance of the resulting golf ball is likely to be the same as that of a conventional golf ball. On the other hand, when the amount of the metal salt of the α,β-unsaturated carboxylic acid is larger than the above range, the center is too hard. Therefore, the shot feel is poor.

The organic peroxide serves as an initiator in case of vulcanizing (crosslinking) rubber. The organic peroxide can be dicumyl peroxide, 1,1-bis(t-butylperoxy)-3,3,5-trimethylcyclohexane, 2,5-dimethyl-2,5-di(t-butylperoxy)-hexane, di-t-butyl peroxide and the like. The amount of the organic peroxide is not specifically limited, but is preferably from about 0.5 to 3 parts by weight based on 100 parts by weight of the base rubber.

The filler can be zinc oxide, barium sulfate, calcium carbonate and the like. The amount of the filler is not specifically limited, but is preferably from about 20 to 40 parts by weight based on 100 parts by weight of the base rubber.

The center is obtained by vulcanization-molding the rubber composition for the center into a spherical form. In case of vulcanization molding, for example, a press molding is used. The vulcanization molding due to the press molding is generally conducted by charging the rubber composition for center in a mold, followed by heating at 140°–180° C. under pressure for 10 to 60 minutes. Heating at the time of the vulcanization molding may also be conducted in two steps.

The thread rubber used for forming the thread rubber layer can be the same one as that which has heretofore been used. For example, there can be used those obtained by vulcanizing a rubber composition prepared by formulating sulfur, a vulcanization aid, a vulcanization accelerator and an antioxidant to a natural rubber or a blend rubber of the natural rubber and a synthetic polyisoprene.

In the present invention, the hardness of the cover is preferably from 65 to 75 in Shore D-scale hardness. When the hardness of the cover is higher than 75 in Shore D-scale hardness, the hardness of the golf ball is high and the feeling of at the time hitting is hard. Therefore, the shot feel is poor. On the other hand, when the hardness of the cover is lower than 65 in Shore D-scale hardness, the launch angle is small. Therefore, it is impossible to attain a long flight distance.

The cover is generally formed from a cover composition, comprising an ionomer resin as a main material. Specific examples of the ionomer resin will be shown by a trade name thereof. Examples of the ionomer resin, which is commercially available from Mitsui Du Pont Polychemical Co., include Hi-milan 1605 (Na), Hi-milan 1707 (Na), Hi-milan AM7318 (Na), Hi-milan 1705 (Zn), Hi-milan 1706 (Zn), Hi-milan 1652 (Zn), Hi-milan AM7315 (Zn), Hi-milan AM7317 (Zn), Hi-milan MK7320 (K) and Hi-milan AM7311 (Mg); and Hi-milan 1856 (Na), Hi-milan 1855 (Zn) and Hi-milan AM7316 (Zn) as the terpolymer ionomer resin. Examples of the ionomer resin, which is commercially available from Du Pont U.S.A. include Surlyn 8920 (Na), Surlyn 8940 (Na), Surlyn AD8512 (Na), Surlyn 9910 (Zn), Surlyn AD8511 (Zn), Surlyn 7930 (Li) and Surlyn 7940 (Li); and Surlyn AD8265 (Na) and Surlyn AD8269 (Na) as the terpolymer ionomer resin. Examples of the ionomer resin, which is commercially available from Exxon Chemical Co., include lotek 7010 (Zn) and lotek 8000 (Na). These ionomer resins are used alone or in combination thereof. Incidentally, Na, Zn, Li, K and Mg, which are described in parentheses after the trade name of the above ionomer resin indicate their neutralizing metal ion species.

Inorganic fillers (e.g. zinc oxide, barium sulfate, etc.) and pigments (e.g. such as titanium dioxide, etc.) for coloring can be optionally added to the cover composition, in addition to the resin component such as the ionomer resin, etc.

The method of covering the core (which is a thread wound core comprising a center and a thread rubber layer formed by winding a thread rubber around the center) with the cover is not specifically limited, but may be the conventional method. For example, there can be used a method comprising molding the cover composition into a semi-spherical half-shell in advance, covering a core with two half-shells, followed by pressure molding at 130° to 170° C. for 1 to 15 minutes.

At the time of cover molding, dimples may be optionally formed on the surface of the golf ball. Furthermore, paint finishing or marking may be optionally provided after cover molding.

One embodiment of the golf ball of the present invention will be explained with reference to the accompanying drawing. FIG. 1 is a schematic cross section illustrating one embodiment of the golf ball of the present invention. In FIG. 1, 1 is a center (core), 2 is a thread rubber layer, 3 is a cover and 3*a* represent dimples.

The solid center 1 is composed of a vulcanized molded article of the rubber composition. The diameter of the center is from 35 to 38 mm, and a deformation amount formed by applying a load to the center within the range from an initial load of 10 Kg to a final load of 130 Kg is from 3.5 to 6 mm.

The thread rubber layer 2 is formed by winding the thread rubber in the stretched state around the center 1, and the center 1 and thread rubber layer 2 constitute a core referred to as a "thread wound core". The periphery of the thread rubber layer 2 is covered with the cover 3, and suitable number of dimples 3*a* are optionally provided according to the desired characteristics.

In the present invention, it is necessary that a value obtained by subtracting a deformation amount (B) of the golf ball from a deformation amount (A) of the center is from 0.5 to 3 mm, wherein (A) is a deformation amount of the center 1 and (B) is a deformation amount formed by applying a load to the golf ball within the range from an initial load of 10 Kg to a final load of 130 Kg. The center 1 is preferably composed of a vulcanized molded article of a rubber composition prepared by formulating 19 to 27 parts by weight of an α,β-unsaturated carboxylic acid metal salt to 100 parts by weight of the base rubber. The hardness of the cover 3 is preferably from 65 to 75.

As described above, according to the present invention, there could be provided a multi-layer structure golf ball having a thread rubber layer, which has good shot feel and attains large flight distance, by increasing a launch angle and inhibiting an amount of spin with maintaining good shot feet to increase a flight distance.

EXAMPLES

The following Examples and Comparative Examples further illustrate the present invention in detail but are not to be construed to limit the scope thereof.

Examples 1 to 7 and Comparative Examples 1 to 3

Rubber compositions for center A to G were prepared, respectively, according to the formulation composition shown in Table 1. An amount of each component shown in the Table 1 is represented by parts by weight.

The resulting rubber composition was charged in a die for center and vulcanized under pressure to produce a center. The vulcanization was conducted in two steps, that is, the vulcanization was conducted at 165° C. for 8 minutes after vulcanizing at 140° C. for 30 minutes. The diameter and deformation amount of the resulting center are shown in Table 1. The deformation amount is determined by measuring a deformation amount formed by applying a load to the center within the range from an initial load of 10 Kg to a final load of 130 Kg.

TABLE 1

| Kind of center | | A | B | C | D | E | F | G |
|---|---|---|---|---|---|---|---|---|
| BR-11 | ※1 | 100 | 100 | 100 | 100 | 100 | 100 | 100 |
| Zinc acrylate | | 24 | 20 | 16.5 | 24 | 24 | 10 | 14 |
| Zinc oxide | | 41.3 | 42.4 | 43.3 | 35.0 | 28.9 | 63.8 | 44.0 |
| Antioxidant | ※2 | 0.5 | 0.5 | 0.5 | 0.5 | 0.5 | 0.5 | 0.5 |
| Dicumyl peroxide | | 1.0 | 1.0 | 1.0 | 1.0 | 1.0 | 1.5 | 1.0 |
| Diameter of center (mm) | | 35.3 | 35.3 | 35.3 | 36.5 | 37.8 | 32.0 | 35.3 |
| Deformation amount of center (mm) | | 3.8 | 4.9 | 5.8 | 4.0 | 4.0 | 7.5 | 6.4 |

※1: Trade name, hi-cis polybutadiene whose cis-1,4-butadiene content is not less than 96%, manufactured by Japan Synthetic Rubber Co., Ltd.
※2: Yoshinox 425 (trade name), manufactured by Yoshitomi Pharmaceutical Inds., Ltd.

A thread rubber layer was formed by winding a thread rubber made of a blend rubber of a natural rubber/low cis-synthetic polyisoprene (weight ratio: 50/50) [Shell IR-309 (trade name), manufactured by Shell Chemical Co.] in the stretched state around each center obtained as described above, thereby producing a core having an outer diameter of 38.9 mm.

Then, the cover compositions X to Z were prepared, respectively, according to the formulation composition shown in Table 2. An amount of each component shown in the Table 2 is represented by parts by weight.

TABLE 2

| | | X | Y | Z |
|---|---|---|---|---|
| Iotek 8000 | ※3 | 50 | 0 | 0 |
| Iotek 7010 | ※4 | 50 | 0 | 0 |
| Hi-milan 1605 | ※5 | 0 | 50 | 0 |
| Hi-milan 1706 | ※6 | 0 | 50 | 25 |
| Hi-milan 1707 | ※7 | 0 | 0 | 25 |
| Hi-milan 1652 | ※8 | 0 | 0 | 25 |
| Hi-milan 1855 | ※9 | 0 | 0 | 25 |
| Titanium dioxide | | 2 | 2 | 2 |

※3: Iotek 8000 (trade name), ethylene-acrylic acid copolymer ionomer resin obtained by neutralizing with a sodium ion, manufactured by Exxon Chemical Co.
※4: Iotek 7010 (trade name), ethylene-acrylic acid copolymer ionomer resin obtained by neutralizing with a zinc ion, manufactured by Exxon Chemical Co.
※5: Hi-milan 1605 (trade name), ethylene-methacrylic acid copolymer ionomer resin obtained by neutralizing with a sodium ion, manufactured by Mitsui Du Pont Polychemical Co., Ltd.
※6: Hi-milan 1706 (trade name), ethylene-methacrylic acid copolymer ionomer resin obtained by neutralizing with a zinc ion, manufactured by Mitsui Du Pont Polychemical Co., Ltd.
※7: Hi-milan 1707 (trade name), ethylene-methacrylic acid copolymer ionomer resin obtained by neutralizing with a sodium ion, manufactured by Mitsui Du Pont Polychemical Co., Ltd.
※8: Hi-milan 1652 (trade name), ethylene-methacrylic acid copolymer ionomer resin obtained by neutralizing with a zinc ion, manufactured by Mitsui Du Pont Polychemical Co., Ltd.
※9: Hi-milan 1855 (trade name), ethylene-butyl acrylate-methacrylic acid terpolymer ionomer resin obtained by neutralizing with a zinc ion, manufactured by Mitsui Du Pont Polychemical Co., Ltd.

A golf ball having an outer diameter of 42.7 mm was produced by molding a semi-spherical half-shell from the cover composition of thus obtained, covering the core with a couple of half-shells, pressure-molding in a die for golf ball at 155° C. for 3 minutes and applying paint on the surface.

With respect to the resulting golf balls, the deformation amount, flight performance (launch angle, spin amount, elevation angle of trajectory and flight distance) and shot feel (feeling at the time of hitting) were examined. Their measurement and evaluation methods are as follows.

Deformation amount of golf ball:

A deformation amount (mm) is measured by applying a load to a golf ball within the range from an initial load of 10 Kg to a final load of 130 Kg.

Flight performance:

After a No. 1 wood club was mounted to a swing robot manufactured by True Temper Co. and a golf ball was hit at a head speed of 45 m/second, the launch angle, spin amount, elevation angle of trajectory and flight distance (carry) to the dropping point of the hit golf ball are measured.

Shot feel:

The shot feel of the golf ball is evaluated by 10 top professional golfers according to a practical hitting test using a No. 1 wood club. The evaluation criteria are as follows. The results shown in the Tables below are based on the fact that not less than 8 out of 10 professional golfers evaluated with the same criterion about each test item.

Evaluation criteria:

◎: Very good

○: Good

X: Hard and poor

The evaluation results of the flight performance and shot feel are shown in Table 3 to Table 5, together with the structural physical properties the golf balls. Examples of the structural physical properties of the golf ball include kind of the center, diameter of the center, deformation amount of the center, deformation amount of the golf ball, value obtained by subtracting the deformation amount of the golf ball from that of the center [(A)–(B), shown in Table 3 to Table 5], kind of the cover, hardness of the cover and thickness of the cover. Those with respect to Examples 1 to 4 are shown in Table 3 and those with respect to Examples 5 to 7 are shown in Table 4. Those with respect to Comparative Examples 1 to 3 are shown in Table 5.

TABLE 3

| | Example No. | | | |
|---|---|---|---|---|
| | 1 | 2 | 3 | 4 |
| Structural physical properties of golf ball: | | | | |
| Kind of center | A | A | A | B |
| Diameter of center (mm) | 35.3 | 35.3 | 35.3 | 35.3 |
| Deformation amount of center (mm) | 3.8 | 3.8 | 3.8 | 4.9 |
| Deformation amount of golf ball (mm) | 3.2 | 3.15 | 3.1 | 3.3 |
| (A) – (B) (mm) | 0.6 | 0.65 | 0.7 | 1.6 |
| Kind of cover | Z | Y | X | X |
| Hardness of cover (Shore D-scale hardness) | 65 | 67 | 71 | 71 |
| Thickness of cover (mm) | 1.9 | 1.9 | 1.9 | 1.9 |
| Flight performance (W#1, 45 m/s) | | | | |
| Launch angle (°) | 11.76 | 11.78 | 11.80 | 11.82 |
| Spin amount (rpm) | 2870 | 2820 | 2800 | 2830 |
| Elevation angle of trajectory (°) | 13.07 | 13.10 | 13.16 | 13.18 |
| Flight distance (yard) | 226.5 | 226.9 | 229.3 | 227.6 |
| Shot feel | ○ | ○ | ○ | ○ |

TABLE 4

| | Example No. | | |
|---|---|---|---|
| | 5 | 6 | 7 |
| Structural physical properties of golf ball: | | | |
| Kind of center | C | D | E |
| Diameter of center (mm) | 35.3 | 36.5 | 37.8 |
| Deformation amount of center (mm) | 5.8 | 4.0 | 4.0 |
| Deformation amount of golf ball (mm) | 3.0 | 3.1 | 3.1 |
| (A) – (B) (mm) | 2.8 | 0.9 | 0.9 |
| Kind of cover | X | X | X |
| Hardness of cover (Shore D-scale hardness) | 71 | 71 | 71 |
| Thickness of cover (mm) | 1.9 | 1.9 | 1.9 |
| Flight performance (W#1, 45 m/s) | | | |
| Launch angle (°) | 11.85 | 11.93 | 12.07 |
| Spin amount (rpm) | 2870 | 2730 | 2650 |
| Elevation angle of trajectory (°) | 13.23 | 13.08 | 13.05 |
| Flight distance (yard) | 227.2 | 228.7 | 228.2 |
| Shot feel | ◎ | ○ | ○ |

TABLE 5

| | Comparative Example No. | | |
|---|---|---|---|
| | 1 | 2 | 3 |
| Structural physical properties of golf ball: | | | |
| Kind of center | F | A | G |
| Diameter of center (mm) | 32 | 35.3 | 35.3 |
| Deformation amount of center (mm) | 7.5 | 3.8 | 6.4 |
| Deformation amount of golf ball (mm) | 3.2 | 3.4 | 2.9 |
| (A) – (B) (mm) | 4.3 | 0.4 | 3.5 |
| Kind of cover | X | X | X |
| Hardness of cover (Shore D-scale hardness) | 71 | 71 | 71 |
| Thickness of cover (mm) | 1.9 | 1.9 | 1.9 |
| Flight performance (W#1, 45 m/s) | | | |
| Launch angle (°) | 11.20 | 11.72 | 11.86 |
| Spin amount (rpm) | 3130 | 2850 | 2920 |
| Elevation angle of trajectory (°) | 12.90 | 13.04 | 12.98 |
| Flight distance (yard) | 223.6 | 226.3 | 225.1 |
| Shot feel | ◎ | X | ◎ |

As is apparent from Table 3 to Table 4, the golf balls of Examples 1 to 7 showed good shot feel and attained large flight distance. That is, regarding the golf balls of Examples 1 to 7 wherein the diameter of the center is within the range from 35 to 38 mm, the deformation amount of the center is within the range from 3.5 to 6 mm and (A)–(B), namely, value obtained by subtracting the deformation amount (B) of the golf ball from the deformation amount (A) of the center is within the range from 0.5 to 3 mm, the evaluation result of the shot feel was good or very good and the shot feel was good. Also, the flight distance was large such as 226.5–229.3 yards.

To the contrary, the golf ball of Comparative Example 1 corresponds to a golf ball having a conventional construction of a multi-layer structure golf ball having a thread rubber layer. Since the diameter of the center is smaller than the range defined in the present invention and the deformation amount of the center is larger than the range defined in the present invention (that is, the center is softer than that of the present invention), the launch angle is smaller than that of the golf balls of Examples 1 to 7 and the spin amount is large. Therefore, the flight distance was small, as shown in Table 5.

Regarding the golf ball of Comparative Example 2, (A)–(B), namely, value obtained from subtracting the deformation amount (B) of the golf ball from the deformation amount (A) of the center is smaller than the range defined in the present invention. Therefore, the shot feel was hard and poor as shown in Table 5. Regarding the golf ball of Comparative 20 Example 3, (A)–(B), namely, value obtained from subtracting the deformation amount (B) of the golf ball from the deformation amount (A) of the center is larger than the range defined in the present invention. Therefore, the flight distance was only 225.1 yards and was inferior to the golf balls of Examples 1 to 7, as shown in Table 5.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

what is claimed is:

1. A golf ball comprising a center made of a vulcanized molded article of a rubber composition, a thread rubber layer formed on the center and a cover formed on the thread rubber layer, wherein the center has a diameter of from 35 to 38 mm and a deformation amount, formed by applying a load to the center within the range from an initial load of 10 Kg to a final load of 130 Kg, of from 3.5 to 6 mm, and when the deformation amount of the center is defined as deformation amount (A) and the deformation amount of the golf ball, formed by applying a load to the golf ball within the range from an initial load of 10 Kg to a final load of 130 Kg, is defined as deformation amount (B), the deformation amounts (A) and (B) meet the following equation:

Deformation amount (A)−deformation amount (B)=0.5 to 3 mm.

2. The golf ball according to claim 1, wherein the center is composed of a vulcanized molded article of a rubber composition comprising 100 parts by weight of a base rubber and 19 to 27 parts by weight of an $\alpha,\beta$-unsaturated carboxylic acid metal salt.

3. The golf ball according to claim 1, wherein the cover has a Shore D-scale hardness of from 65 to 75.

* * * * *